United States Patent [19]

Hauch et al.

[11] Patent Number: 5,042,170

[45] Date of Patent: Aug. 27, 1991

[54] LINT COLLECTING DEVICE

[75] Inventors: Dennis W. Hauch, Baroda Township, Berrien County; Kurt Werner, St. Joseph Township, Berrien County, both of Mich.

[73] Assignee: Whirlpool Corporation, Benton Harbor, Mich.

[21] Appl. No.: 576,956

[22] Filed: Sep. 4, 1990

[51] Int. Cl.[5] ..... D06F 58/22; F26B 11/04

[52] U.S. Cl. ..... 34/82; 34/88; 34/133; 55/274

[58] Field of Search ..... 34/82, 88, 133; 55/274

[56] References Cited

U.S. PATENT DOCUMENTS

| | | | |
|---|---|---|---|
| 2,486,058 | 10/1949 | Patterson et al. . | |
| 2,764,820 | 10/1956 | Kauffman, II . | |
| 2,843,945 | 7/1958 | Whyte . | |
| 3,047,963 | 8/1962 | Richterkessing . | |
| 3,066,422 | 12/1962 | Douglas . | |
| 3,157,390 | 11/1964 | Douglas | 34/133 X |
| 3,378,934 | 4/1968 | Erickson | 34/82 |
| 3,579,851 | 5/1971 | Elmy . | |
| 3,718,982 | 3/1973 | Deaton | 55/274 X |
| 3,748,746 | 7/1973 | Robandt | 34/82 |
| 4,314,409 | 2/1982 | Cartier et al. | 34/82 |
| 4,462,170 | 7/1984 | Burkall et al. | 34/133 X |
| 4,653,200 | 3/1987 | Werner | 34/133 X |
| 4,700,492 | 10/1987 | Werner et al. | 34/82 X |
| 4,779,456 | 10/1988 | Cantoni | 55/274 X |

*Primary Examiner*—Henry A. Bennett
*Assistant Examiner*—Christopher Kilner
*Attorney, Agent, or Firm*—Hill, Van Santen, Steadman & Simpson

[57] ABSTRACT

A lint collecting device, particularly suited for use in a clothes dryer has an access opening through a front wall of the dryer above the horizontal access of the dryer and laterally offset and spaced from a vertical line passing through the access. The lint collecting device includes a lint screen held horizontally in a lint collecting zone formed in an air duct within the dryer cabinet and a viewing window is provided in the air duct and the dryer cabinet to render a portion of the lint screen visible from the exterior of the cabinet. A light source may be provided for illuminating a portion of the lint screen.

16 Claims, 3 Drawing Sheets

LINT COLLECTING DEVICE

BACKGROUND OF THE INVENTION

The present invention relates to lint collecting devices, and more particularly to lint collecting devices in a domestic dryer.

Lint collecting devices in domestic clothes dryers are well known, in fact virtually every domestic dryer has a lint collecting device. Such devices generally include a screen upon which the lint is captured when lint laden air exiting the dryer is caused to pass through the screen.

In some dryers the screen is positioned so that it can be removed from the front of the dryer. For example in U.S. Pat. No. 2,486,058 the lint screen forms part of a drawer which is centered at the top front of the dryer cabinet, above the dryer drum. To view and remove the screen, the user must pull on a handle on the drawer to expose the screen. In U.S. Pat. No. 2,764,820, the lint screen is positioned at a bottom corner of the dryer cabinet below the dryer drum. The screen is not visible until the screen is pulled from the dryer cabinet, however the specification suggests that the user will be warned that the lint trap needs emptying when lint begins to accumulate on the floor in front of the dryer. U.S. Pat. No. 3,579,851 discloses a lint collector which is positioned in a centered location at the front of the dryer cabinet near the bottom of the cabinet, below the dryer drum. The lint collecting tray is caused to move to an open position each time the dryer door is opened to remind the user to clean the screen. The screen is not visible until the tray is moved to an open position.

SUMMARY OF THE INVENTION

The present invention provides a lint collecting device comprising an air duct through which lint laden air is directed, means for collecting lint, such as a lint screen, positioned in a lint collecting zone in the duct, and means for rendering at least a portion of the collecting means in the lint collecting zone visible from an exterior of the duct. Such an improvement permits a user to view the lint screen while a dryer or other lint generating device is running, or to view the screen without removing it in order to determine whether the screen needs to be cleaned.

In a preferred embodiment of the invention, a transparent window is provided in the duct to permit the viewing to occur. It may also be desirable to include a light source illuminating at least the portion of the means for collecting lint which is visible through the window.

A preferred environment for the lint collecting device is a clothes dryer having a cabinet enclosing a horizontal axis drum for receiving a load of fabric to be dried; means for directing a flow of air through the drum to dry the fabric including an exhaust vent positioned at a rear of the drum communicating with an exhaust duct interior of the cabinet, the duct having a horizontal portion; means for collecting lint removably positioned in the horizontal portion of the duct; and an access opening for receiving the means for collecting lint in a front wall of the cabinet. Preferably the access opening is offset and spaced from a vertical line passing through said horizontal drum axis. In this manner the height of the dryer cabinet does not have to be enlarged to accommodate the lint collecting device since it can be positioned in an unused quadrant of the dryer cabinet.

In an embodiment of the invention, the front access lint screen is provided in a dryer with a rear venting drum. In such a structure both the air inlet and air outlet can be positioned in a stationary rear bulkhead, thus avoiding complicated wall structures and seals to accommodate a stationary wall and exhaust ducts at a front of the drum.

DESCRIPTION OF THE PREFERRED EMBODIMENTS

Figure 1:
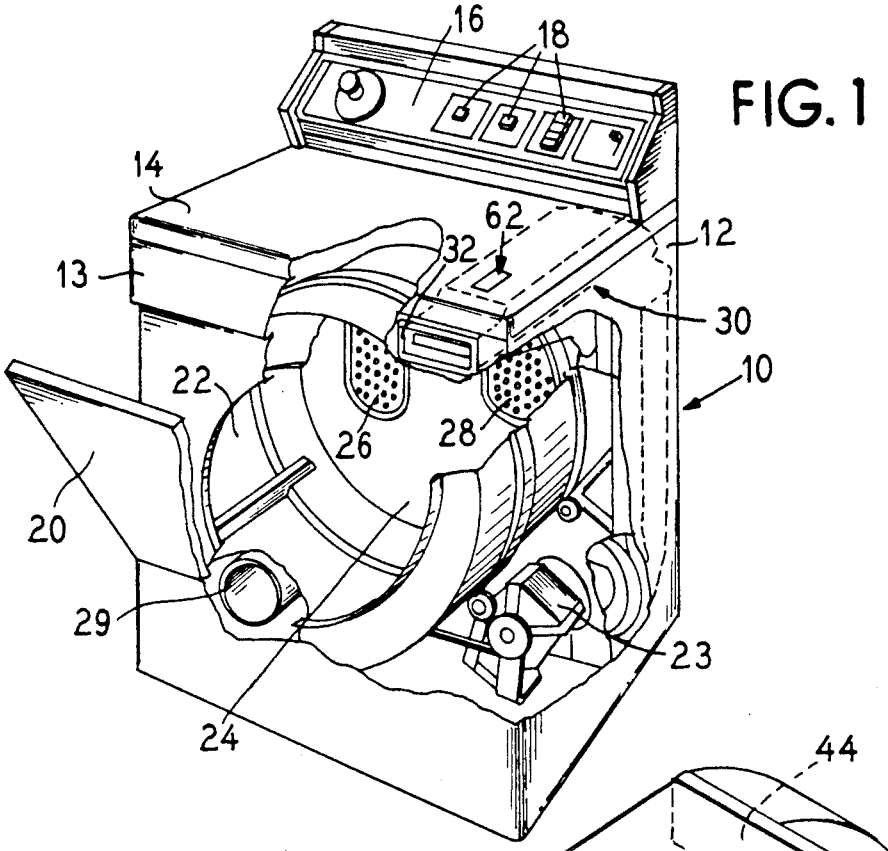
FIG. 1 is a perspective view of a dryer partially cut away to show a lint collecting device embodying the present invention.
Figure 2:
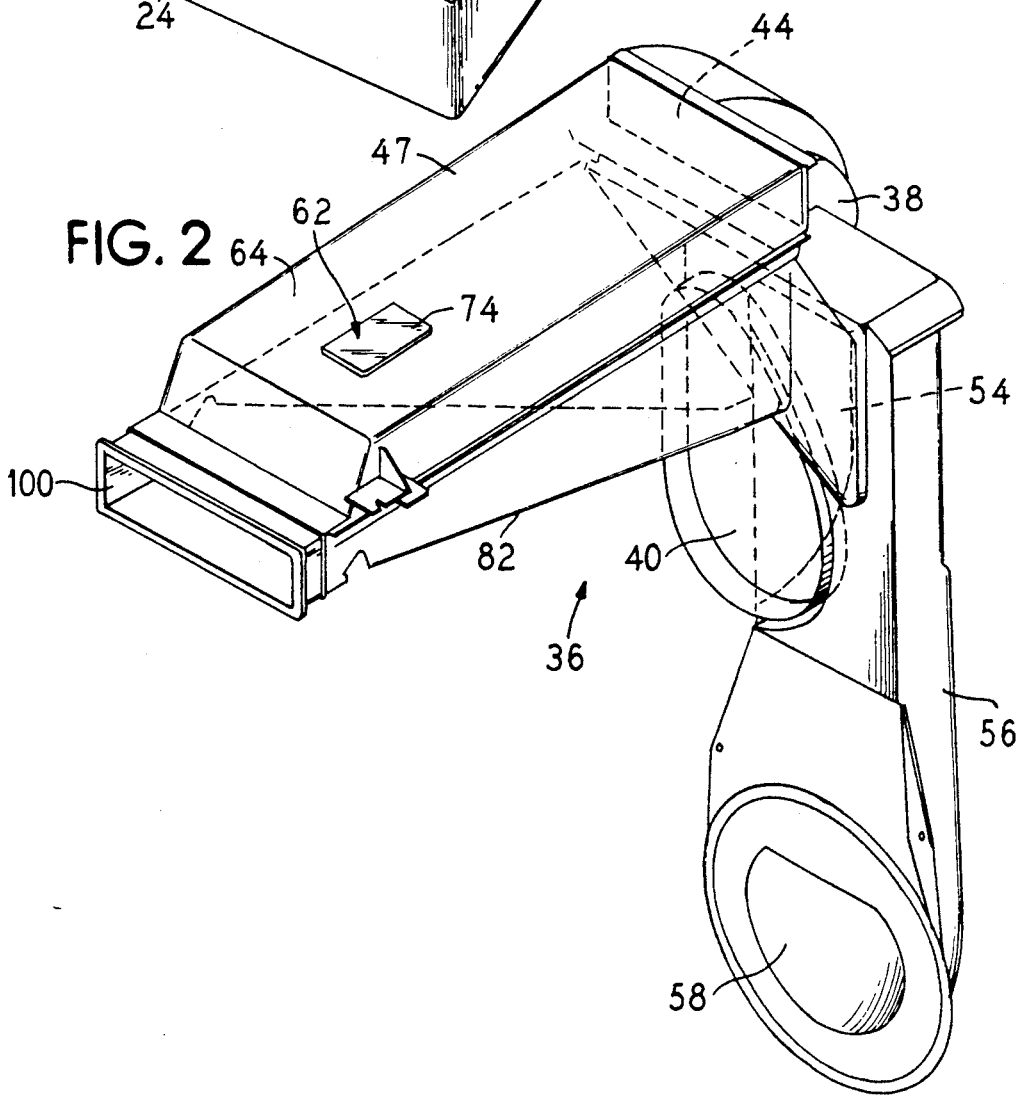
FIG. 2 is a perspective view of the duct assembly in which the lint collecting device is positioned.

In FIG. 1 there is illustrated a clothes dryer generally at 10 having a cabinet 12 with a front wall 13 and a top wall 14. At a rear of the top wall 14 there is a control panel 16 having a plurality of controls 18 thereon some of which are manually actuatable by a user to cause the dryer to proceed through a sequence of drying steps.

At the front wall 13 of the dryer 10 there is an openable door 20 providing access to the interior of a horizontal axis dryer drum 22. A motor 23 is operated to rotate the drum 22 about its horizontal axis. The dryer drum includes a stationary rear bulkhead 24 having an air inlet 26 and an exhaust outlet 28 therein. Air is heated in a heater 29 and is directed to the interior of the drum 22 through the inlet 26 to absorb moisture from the clothes, and to pick up lint from the clothes. The air is exhausted through the outlet 28 and is caused to flow through a lint collecting device 30 embodying the principles of the present invention. The lint collecting device is removed and replaced by means of an access opening 32 in the front wall 13 of the dryer cabinet.

Figures 3, 4:
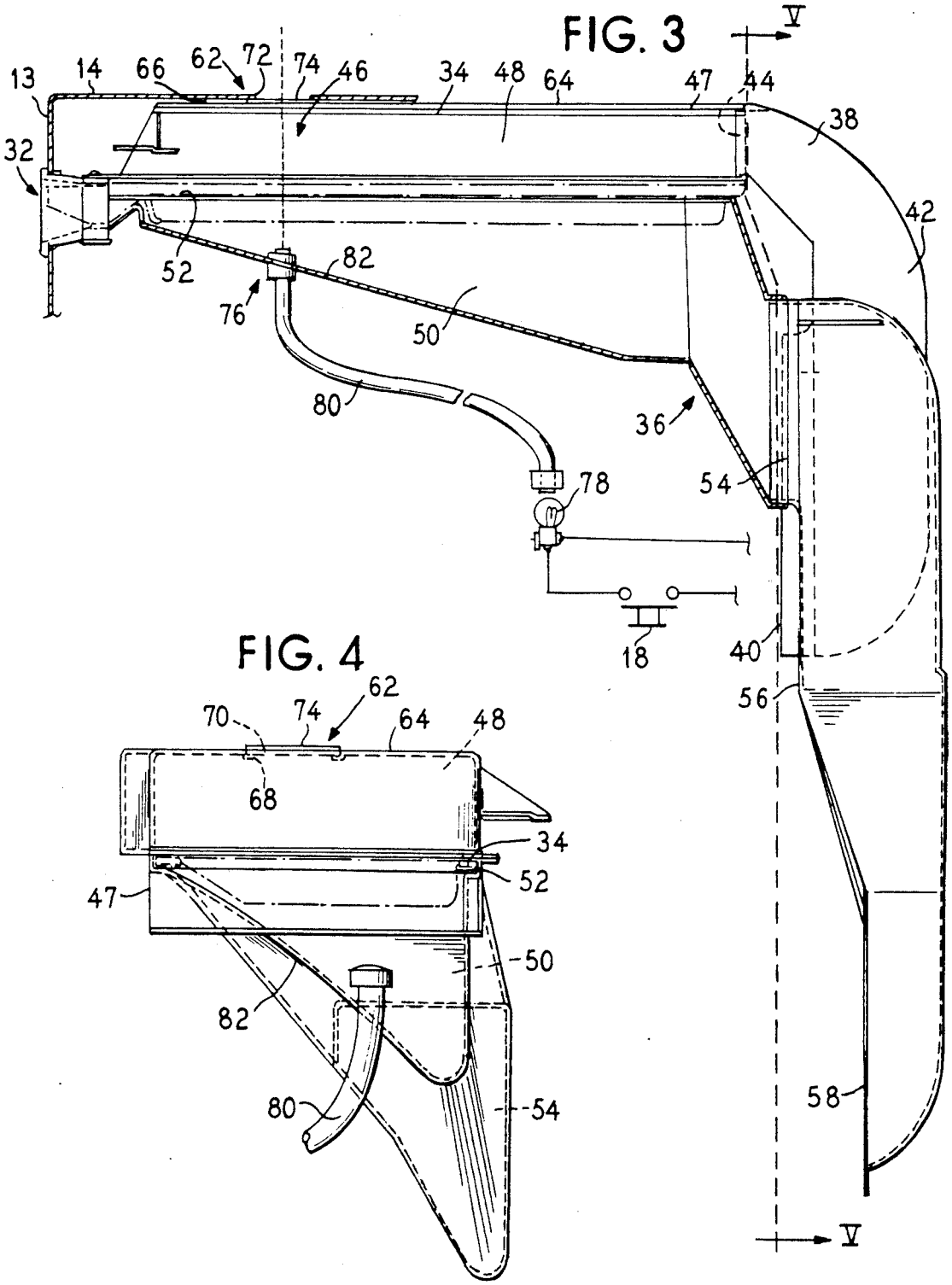
FIG. 3 is a side view of the duct assembly of FIG. 2 with a schematic illustration of a light path for the lint collecting device.
FIG. 4 is a front view of a second duct of the duct assembly.
Figure 5:
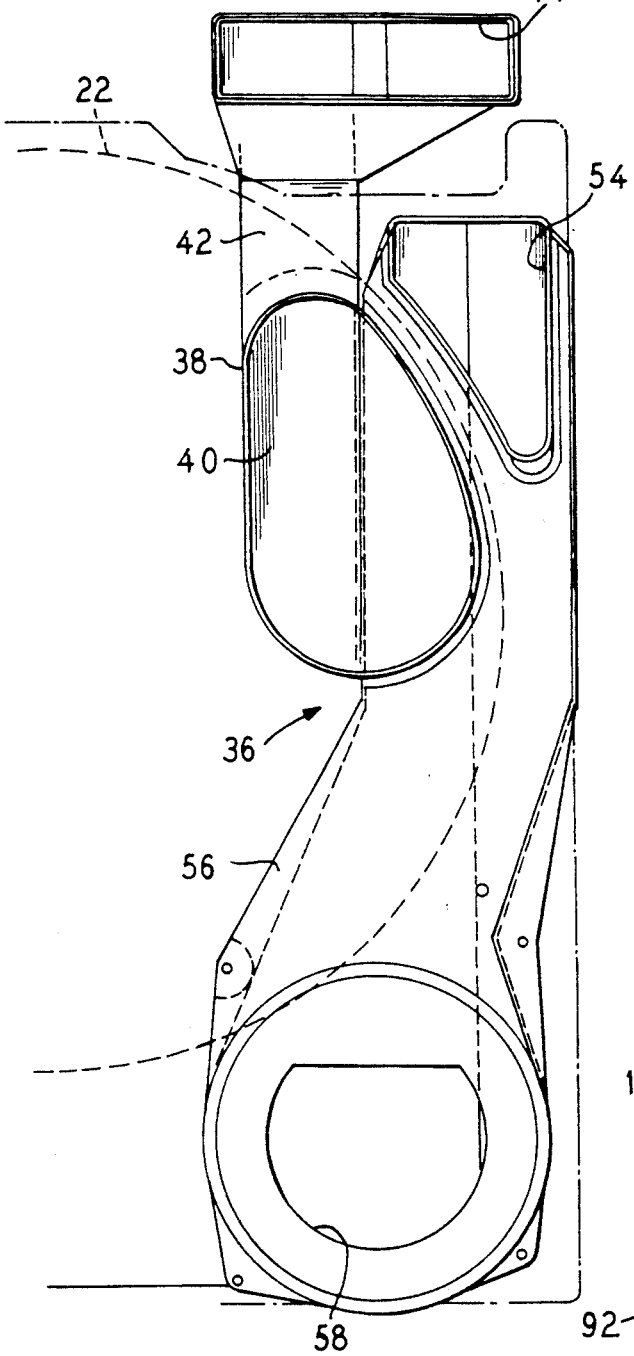
FIG. 5 is a front view of the duct assembly.
Figure 6:
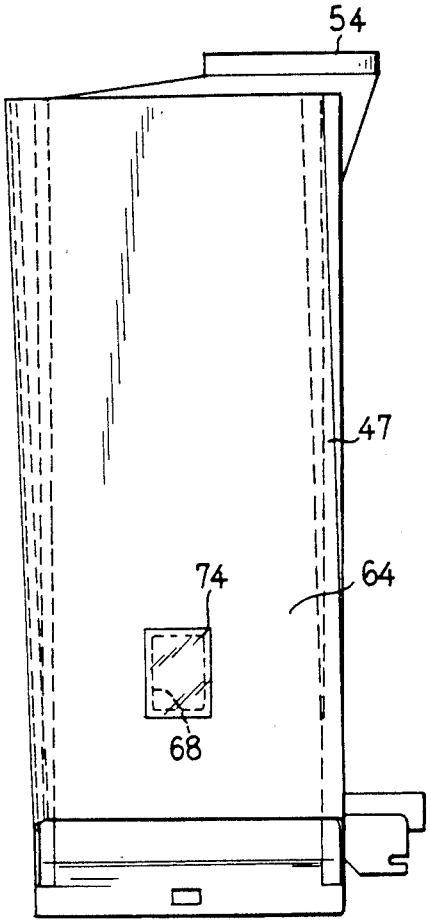
FIG. 6 is a top view of the second duct with the viewing window.

The lint collecting device 30 comprises a lint screen 34 which is positioned in an exhaust duct assembly 36 shown in greater detail in FIGS. 2–7. The exhaust duct assembly 36 is comprised of a first exhaust duct 38 having an opening 40 which is aligned with and secured to the exhaust outlet 28 on the rear bulkhead 24 in the dryer drum 22 Moist lint laden air enters the first exhaust duct 38 and flows upwardly through a vertical portion 42 of the first duct 38 and then flows through an opening 44 leading to a horizontal space 46 formed by a second exhaust duct 47. Positioned generally horizontally in the second duct 47 and dividing the horizontal space into an upper region 48 and a lower region 50 is the lint screen 34. Thus, the horizontal space 46 comprises a lint collecting zone. As best seen in FIG. 4, the second duct 47 is formed with a horizontal track 52 in the area forming the horizontal space 46, which track 52 slidingly receives the lint screen 34.

Air flows through the lint screen from the upper region 48 into the lower region 50 and then exits the second duct 47 through an opening 54 into a third exhaust duct 56. The air flows vertically downward in the third duct 56 to an opening 58 which connects with an exhaust conduit which leads the moist, but mostly lint free air away from the dryer.

By having the air flow through the top of the lint screen 34, lint is collected on the top of the screen. Thus, when the lint screen is removed for cleaning, all of the lint will remain on the screen and will not drop off, as contrasted to lint screens wherein the lint is collected on a vertical surface or on the underside of a screen. Such an arrangement allows for improved cleanliness of the laundry area.

The exhaust ducts 42, 47, 56 are sized and arranged within the dryer cabinet so as to occupy an unused space which is offset and spaced from a vertical line passing through the axis of the dryer drum 22. Preferably the upper right or left quadrant of the dryer is selected to permit easy access to the lint screen. Such a space is approximately level with or below an uppermost extent of the dryer drum 22 and is offset and spaced above the horizontal axis of the dryer drum 22.

Also, by positioning the lint screen near the top wall 14 of the dryer cabinet 12 at least a portion of the lint screen can be made visible from the exterior of the dryer cabinet while the screen is in the lint collecting zone 46 by the provision of a transparent, yet air tight window 62 being formed in a top wall 64 of the second duct 47. In a preferred arrangement, a space 66 (FIG. 3) of approximately $\frac{1}{8}$ to $\frac{1}{4}$ inches is provided between the top wall 64 of the second duct 47 and the top wall 14 of the dryer cabinet. The top wall 64 of the second duct has a rectangular opening 68 (FIG. 6) formed therein and has a rectangular recess 70 encircling the opening 68 (FIG. 4). The top wall 14 of the dryer cabinet also has an opening 72 formed therein which will align with the opening 68 in the second duct 47. A window member 74 made of glass, plexiglass, or clear acrylic is then sandwiched between the top wall 14 of the dryer cabinet and the top wall 64 of the second duct 47 and is captured in the recess 70 to prevent lateral movement of the window 74.

To facilitate viewing of the lint screen, a light source 76 (FIG. 3) may be provided for illuminating at least the portion of the lint screen 34 which is visible through the window 62. A preferred light source would be a light bulb 78, normally used to illuminate the interior of the dryer drum 22, with a light guide 80 such as a fiber optic bundle directing some of the light from the bulb 78 through an opening in a bottom wall 82 of the second duct 47 just below the opening 68 in the top wall 64 of the second duct. One of the controls 18 may be operated to energize the light bulb 78 when the user desires to view the lint screen 34, thus preventing continuous operation of the bulb 78. A wiper, not shown, may be provided on the lint screen to clean the light source 76 on removal and replacement of the lint screen 34.

Figure 7:
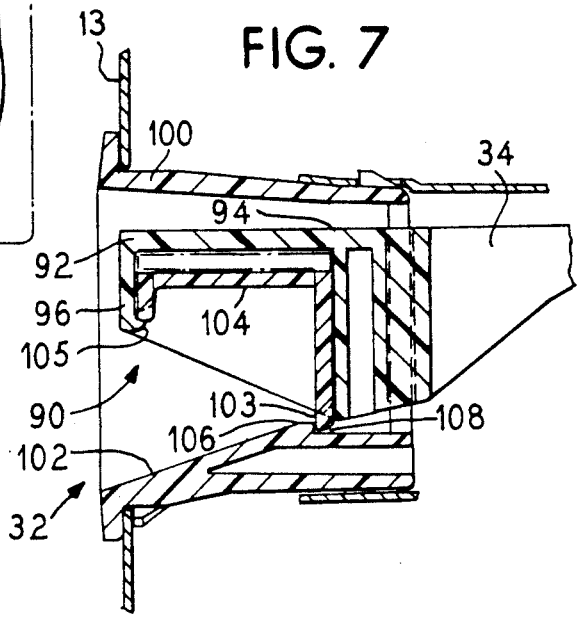
FIG. 7 is a side sectional view of the lint screen handle with a safety interlock mechanism.

The lint screen 34 is removed from and replaced in the second duct 47 through the access opening 32 in the front wall 13 of the dryer cabinet. The access opening is also offset and spaced from the vertical line passing through the axis of the drum 22. As best seen in FIG. 7, a handle and safety interlock arrangement 90 may be provided to assist in removal and retention of the lint screen. The handle and safety interlock system comprises a handle 92 formed at a front end 94 of the lint screen 34 which has a manually engageable and downwardly depending lip 96 at a forward edge 98 of the handle. A housing 100 is provided in the access opening 32 of the dryer cabinet which is sized to receive the handle 92 and which has a ramped lower wall 102 for engagement by a lower rear edge 103 of a vertically moveable inverted L-shaped member 104. A detent 105 prevents the L-shaped member 104 from moving downwardly beyond a predetermined position shown in FIG. 7. At a top 106 of the ramped lower wall 102 there is a recess 108 which receives the lower rear portion 103 of the L-shaped member when the handle 92 is completely inserted into the housing 100. The handle 92 will then be securely held in the housing 100 and cannot be removed without raising the L-shaped member 104 vertically to release the lower rear portion 103 from the housing 100. With such a safety interlock, removal of the lint screen by small children will be minimized.

By placing the lint screen access opening 32 exterior of the cabinet, the lint screen can be cleaned during a cycle without shutting off the dryer. By placing the access opening in the front wall of the dryer, a clean and unobstructed top surface of the dryer will be available to the user for folding clothes, etc. With the exhaust duct assembly 36 positioned in an upper quadrant of the dryer cabinet, less wiring is required between the control console 16 and thermostats (not shown) which are positioned in the exhaust ducts in a known manner. This permits more accurate temperature sensing as well as reduced manufacturing expense.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A clothes dryer comprising:

a cabinet enclosing a horizontal axis drum for receiving a load of fabric to be dried;

means for directing a flow of air through said drum to dry said fabric including an exhaust vent positioned at a rear of said drum communicating with an exhaust duct interior of said cabinet, said duct having a horizontal portion;

means for collecting lint removably positioned in said horizontal portion of said duct; and an access opening for receiving said means for collecting lint in a front wall of said cabinet.

2. A clothes dryer according to claim 1, including means rendering at least a portion of said means for collecting lint visible from an exterior of said cabinet while said portion is positioned in said lint collecting zone.

3. A clothes dryer according to claim 2, wherein said means for rendering comprises a transparent window in said duct and cabinet.

4. A clothes dryer according to claim 1, wherein said access opening is offset and spaced from a vertical line passing through said horizontal drum axis.

5. A clothes dryer according to claim 1, wherein said means for collecting lint comprises a screen.

6. A clothes dryer according to claim 3, wherein said dryer includes a light source therein illuminating at least said portion of said means for collecting lint visible through said window.

7. A clothes dryer according to claim 1, wherein said screen is removable from said dryer by means of a handle and an interlock mechanism is provided to prevent unauthorized removal of said screen from said dryer.

8. A clothes dryer comprising:

a cabinet with a vertical front wall and a horizontal top wall enclosing a horizontal axis drum for receiving a load of fabric to be dried;

means for directing a flow of air through said dryer drum to dry said fabric including an exhaust duct within said cabinet defining a lint collecting zone;

means for collecting lint removably positioned in said lint collecting zone;

an access opening for receiving said means for collecting lint in said front wall of said cabinet; and means in said top wall of said cabinet for rendering at least a portion of said means for collecting lint visible from an exterior of said cabinet while said portion is positioned in said lint collecting zone.

9. A clothes dryer according to claim 8, wherein said means for COllecting lint comprises a screen.

10. A clothes dryer according to claim 8, wherein said means for rendering comprises a transparent window in said duct and cabinet.

11. A clothes dryer according to claim 8, wherein said access opening is offset and spaced from a vertical line passing through said horizontal drum axis.

12. A clothes dryer according to claim 10, wherein said dryer includes a light source therein illuminating at least said portion of said means for collecting lint visible through said window.

13. A clothes dryer according to claim 8, wherein said screen is removable from said dryer by means of a handle and an interlock mechanism is provided to prevent unauthorized removal of said screen from said dryer.

14. A clothes dryer comprising:

a cabinet enclosing a drum rotatable about a horizontal axis for receiving a load of fabric to be dried;

means for directing a flow of air through said dryer drum to dry said fabric including an exhaust duct within said cabinet defining a lint collecting zone;

means for collecting lint removably positioned in said lint collecting zone; and an access opening for said means for collecting lint in a front wall of said cabinet, said access opening being offset and spaced from a vertical line passing through said horizontal axis and being offset and spaced above said horizontal axis.

15. A clothes dryer according to claim 14, wherein said means for collecting lint comprises a screen.

16. A clothes dryer according to claim 15, wherein said screen is removable from said dryer by means of a handle and an interlock mechanism is provided to prevent unauthorized removal of said screen from said dryer.

* * * * *